United States Patent [19]

Reiner et al.

[11] 4,026,066

[45] May 31, 1977

[54] OPTICAL ILLUSION-PRODUCING ROTATING TOY

[75] Inventors: Lawrence L. Reiner, Woodbury, N.Y.; John P. McNett, Short Hills, N.J.

[73] Assignee: Lawrence L. Reiner, Woodbury, N.Y.

[22] Filed: Sept. 18, 1975

[21] Appl. No.: 614,557

[52] U.S. Cl. ..... 46/47; 40/106.3; 46/1 R; 46/11; 46/13; 46/116; 272/8 N; 312/125; 312/305

[51] Int. Cl.[2] ..... A63H 33/22

[58] Field of Search ..... 46/47, 48, 49, 59, 13, 46/32, 116, 11; 40/106.3, 68.4; 272/8 R, 8 M, 8 D, 13, 21, 8 N; 312/286, 33, 125, 305

[56] References Cited

UNITED STATES PATENTS

| | | | |
|---|---|---|---|
| 249,800 | 11/1881 | Smith | 312/305 X |
| 346,295 | 7/1886 | Levenguth | 312/305 X |
| 877,751 | 1/1908 | Acheson | 312/305 X |
| 941,495 | 11/1909 | Carlson | 312/305 X |
| 1,206,083 | 11/1916 | Behrendt et al. | 272/8 D UX |
| 1,295,232 | 2/1919 | Stewart | 312/125 |
| 2,436,569 | 2/1948 | Halter | 312/33 |
| 2,441,607 | 5/1948 | Walls | 46/13 |
| 2,512,465 | 6/1950 | Moorhouse | 312/125 |
| 2,673,778 | 3/1954 | Wood | 312/125 |
| 3,188,159 | 6/1965 | Wenger et al. | 312/305 |
| 3,488,880 | 1/1970 | Taylor | 46/47X |
| 3,880,484 | 4/1975 | Sicina | 312/125 |

FOREIGN PATENTS OR APPLICATIONS

| | | | |
|---|---|---|---|
| 895,699 | 11/1953 | Germany | 312/305 |

*Primary Examiner*—F. Barry Shay
*Attorney, Agent, or Firm*—Edward F. Levy

[57] ABSTRACT

An optical illusion-producing rotating toy includes a rectangular support housing and a generally cylindrical rotatable housing mounted on the support housing for free rotation about a vertical axis. The rotatable housing has at least two three-dimensional display areas, chambers of compartments angularly disposed about the axis. An axial extension of the rotatable housing projects beyond the support housing for gripping to impart rotation of the rotatable housing. The rotatable housing is provided with a resilient pair of engageable fingers proximate the support housing, and a pair of selection latching members are provided on the support housing each of which has a portion which may be selectively moved for engaging one of the fingers to almost instantaneously stop the rotation of the rotatable housing in a predetermined position. This brings into view one of the display areas at a fixed point of observation. Observation of any one display area is made difficult until the rotatable housing is stopped and, depending on which latching member is actuated, an object in one display area may be made to disappear and reappear by successively bringing that display area and an empty display area into view. A case may be used to house the toy, with foldable panels which unfold to form a play area or environment of which the rotating toy forms a part. The housing rotation may be done by electrical motor means, and the stopping by electromagnetic means.

51 Claims, 17 Drawing Figures

FIG. 1
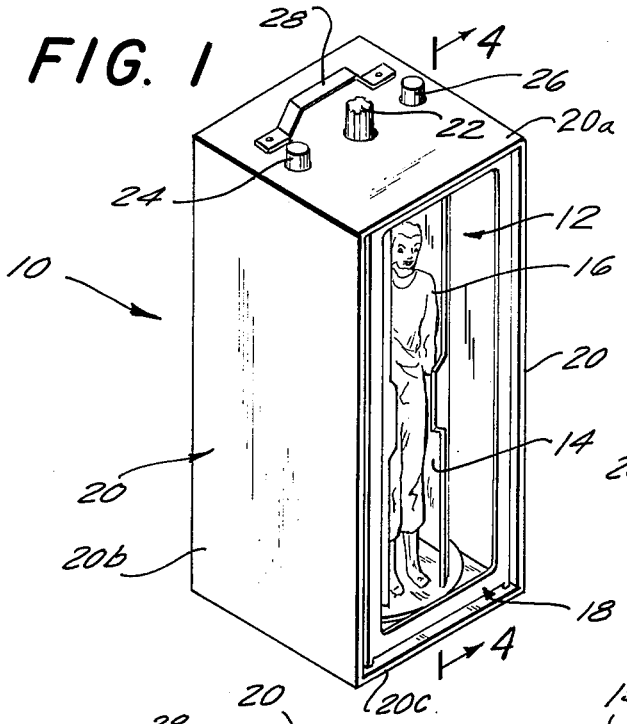
FIG. 10
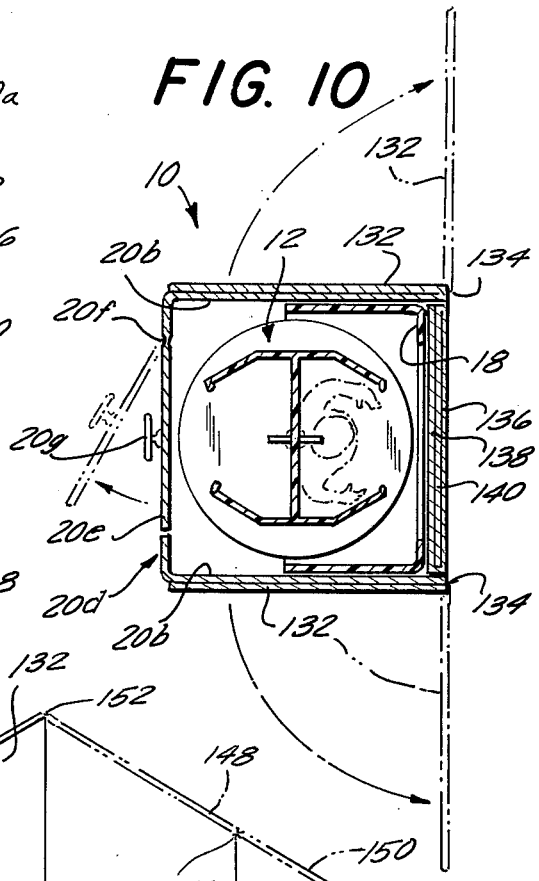
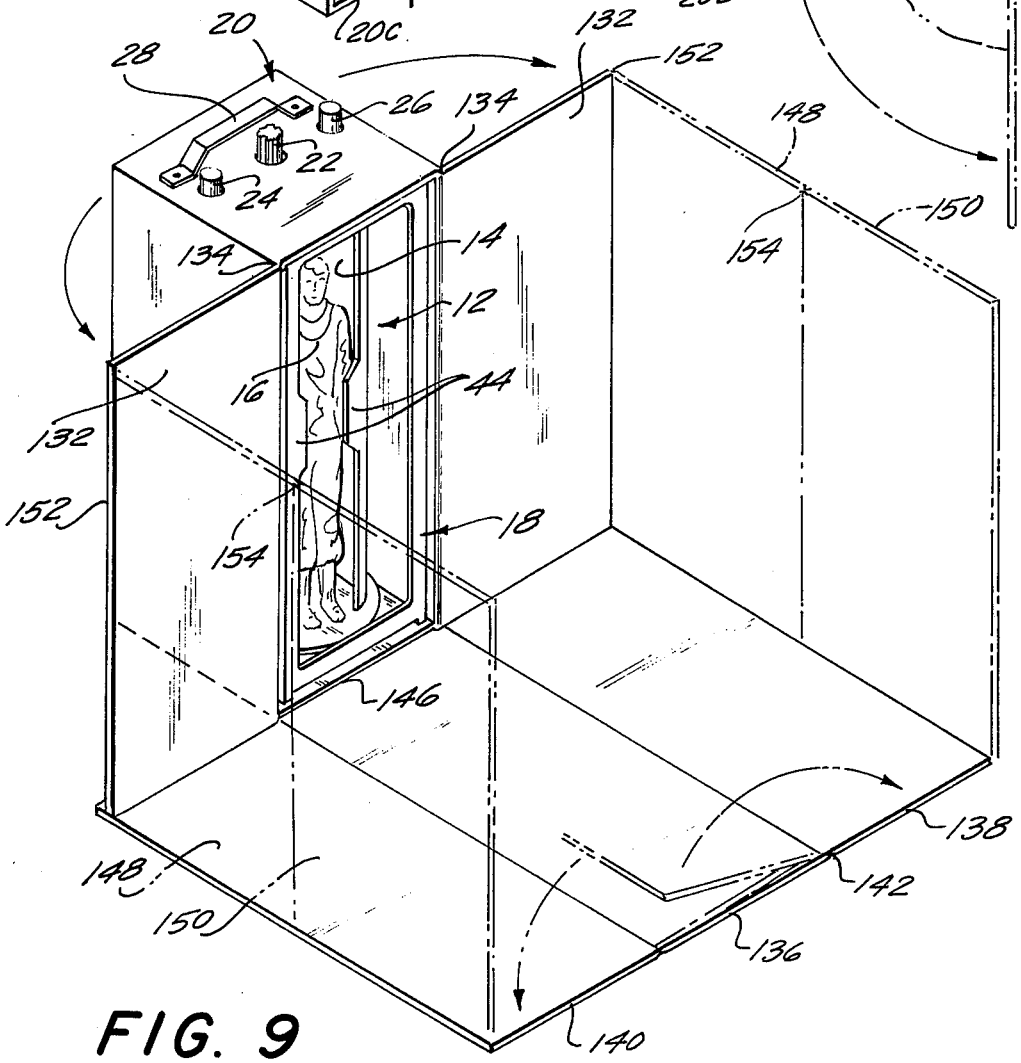
FIG. 9

FIG. 15
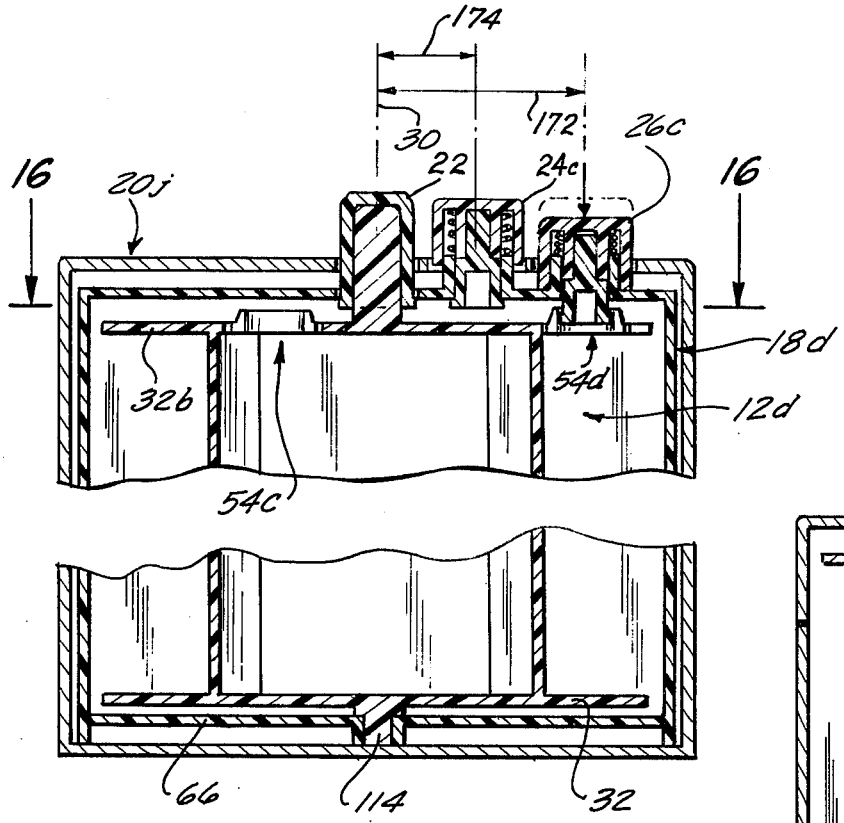
FIG. 17
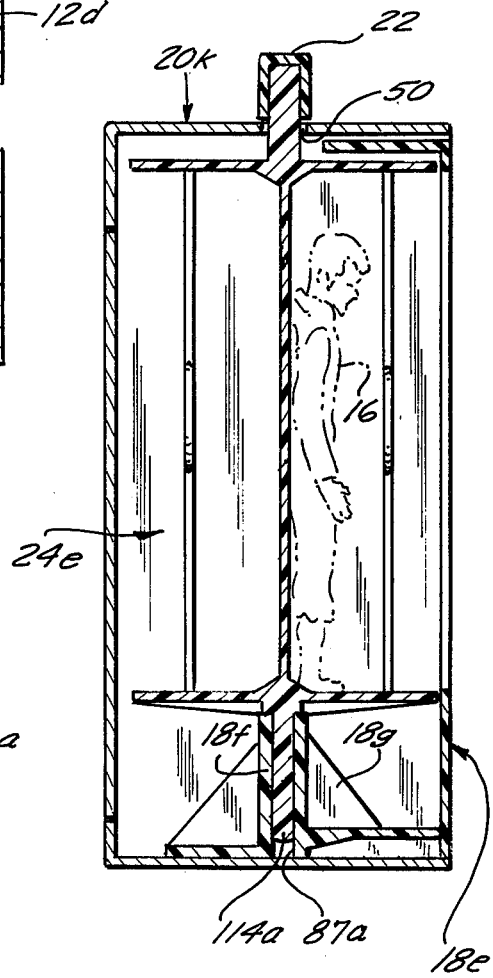
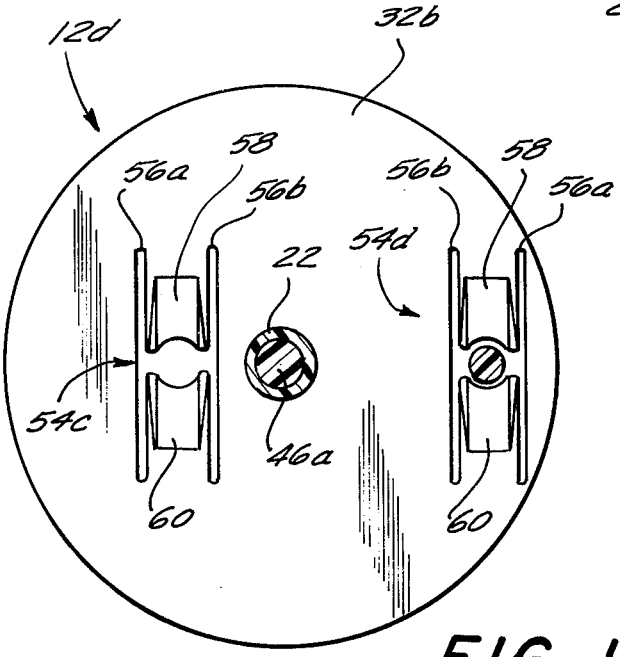
FIG. 16

OPTICAL ILLUSION-PRODUCING ROTATING TOY

BACKGROUND OF THE INVENTION

The present invention generally relates to toys, and more specifically to a rotating toy which can produce an optical illusion which successively results in the disappearance and reappearance of an object.

Numerous rotating toys are known. Some of these rotating toys are educational in nature while others are for amusement. Two educational-type rotating toys are disclosed in U.S. Pat. Nos. 967,591 and 2,608,006. Amusement toys which include revolving or rotating elements are disclosed in the following U.S. Pat. Nos.: 1,227,393; 2,283,104 and 2,460,328. In the case of the educational toys, there is typically provided a drum which bears certain information, whether numerals or letter or words. Turning of the drum brings different information into view. In some cases, different parts of the drum are exposed to similarly bring different information into view, all these being intended to provide a learning experience in both an interesting and entertaining manner. With respect to the amusement rotating toys, these generally relate to rotatable stage or exhibition devices. A screen or sliding curtain is generally provided to block the view of the rotating element while the same is rotating, for example, between one scene and another. Once the element has turned and stopped, the curtain is again opened and the new stage setting may be viewed. In U.S. Pat. No. 1,227,393, a platform is turned and a plurality of paper dolls or cut-out pictures are mounted on a rotating platform which dolls are successively brought into position between a source of light and a screen so that the shadow of the miniature object is thrown on the screen. A make and break electrical circuit is provided to cause illumination only when the object is positioned directly between the screen and the light.

While the closing of a curtain or the turning-off of a source of light provides a period during which a rotating element may be turned to provide a new image when the curtain is opened or the light again energized, these are not optical illusions which are generated by the mere turning and substantially instantaneous stopping of a rotatable element.

With the present invention, an optical illusion is produced by initially rotating a rotatable element at a sufficiently high speed. By providing angularly disposed surfaces or display areas about the axis of the rotatable housing, any one of these surfaces or display areas may be brought into view or made to disappear from view by almost instantaneously stopping the rotation of the rotatable housing in a predetermined angular position. Since it is difficult to observe any one of the surfaces or display areas of the rotatable housing during rotation and it may only be viewed when the rotatable housing is stopped, an object in one display area may be made to disappear and reappear by successively bringing that display area and an empty display area into view. Selection means, in the form of manually actuatable buttons, may be variably disposed above the rotatable housing to engage an engageable portion on the rotatable housing which rotates with rotation of the same.

SUMMARY OF THE INVENTION

Accordingly, it is an object of the present invention to provide an optical illusion-producing rotating toy which provides an effect not hitherto achievable with prior art rotating toys.

It is another object of the present invention to provide a rotating toy of the type under discussion which is simple in construction and economical to manufacture.

It is still another object of the present invention to provide a rotating toy as suggested in the above objects which may be provided with two or more surfaces or display areas disposed about an axis of a rotatable housing, each of which surfaces or display areas may be selectively brought into view by substantially inastantaneously stopping the rotation of the rotatable housing from a rotating condition.

It is yet another object of the present invention to provide a rotating toy as in the last object which provides the optical illusion of appearance and disappearance of an object mounted on the rotatable housing with successive operations of the toy wherein the rotatable housing is stopped in different angular positions about the axis thereof.

It is a further object of the present invention to provide a rotating toy which is mounted or housed in a play case, which play case may be provided with a handle for carrying the same and also provided with a plurality of foldable panels which may be unfolded to produce a play area or environment of which the rotating toy forms a part.

It is still a further object of the present invention to provide a rotating toy which may be initially rotated at a relatively high angular velocity and which includes a plurality of selection means each of which may be manually actuated for substantially instantaneously stopping the rotation of the rotatable housing in an angular position which corresponds to the selection device which has been actuated.

In order to achieve the above objects, as well as others which will become apparent hereafter, an optical illusion-producing rotating toy in accordance with the present invention comprises support means and a generally elongate rotatable housing having an axis of rotation and mounted for free rotation on said support means. Latching means is provided for selectively stopping said housing when the same is rotating in one of at least two angular positions thereof about said axis. In this manner, said rotatable housing, once in a state of rotation, can be selectively stopped in one of said at least two angular positions by suitable actuation of said latching means to bring into view one of two corresponding different sides of said rotatable housing when viewing the same from a single point of observation. Said rotatable housing blends the sides thereof during rotation to make observation of any one individual side difficult until said rotatable housing has been stopped by said latching means.

BRIEF DESCRIPTION OF THE DRAWINGS

Further advantages of the invention will become apparent from a reading of the following specification describing illustrative embodiments of the invention. The specification is to be taken with the accompanying drawings of which:

FIG. 1 is a perspective view of one embodiment of a rotating toy in accordance with the present invention, shown with the rotatable housing of the toy in a stopped position to display an object housed within a display area of the rotatable housing;

FIG. 9 is a perspective view similar to FIG. 1, but further showing the exterior case or container being provided with a plurality of foldable panels which may be unfolded to produce a play area or environment of which the rotating toy forms a part;

FIG. 10 is a transverse cross-section, in plan view, of the toy shown in FIG. 9, suggesting how the foldable panels may be folded and unfolded;

FIG. 15 is a cross-sectional view, which is shown fragmented, of yet another embodiment of the present invention wherein the selection means are variously radially spaced from the axis of the toy to correspond to the variously spaced engageable portions on the rotatable housing from the axis of the same;

FIG. 16 is a cross-sectional view of the embodiment shown in FIG. 15, taken along line 16—16; and FIG. 17 is a longitudinal cross-section of a further embodiment in accordance with the present invention wherein the rotatable housing is rotatably supported at only one and namely the lower end thereof.

DESCRIPTION OF THE PREFERRED EMBODIMENTS

Figure 2:
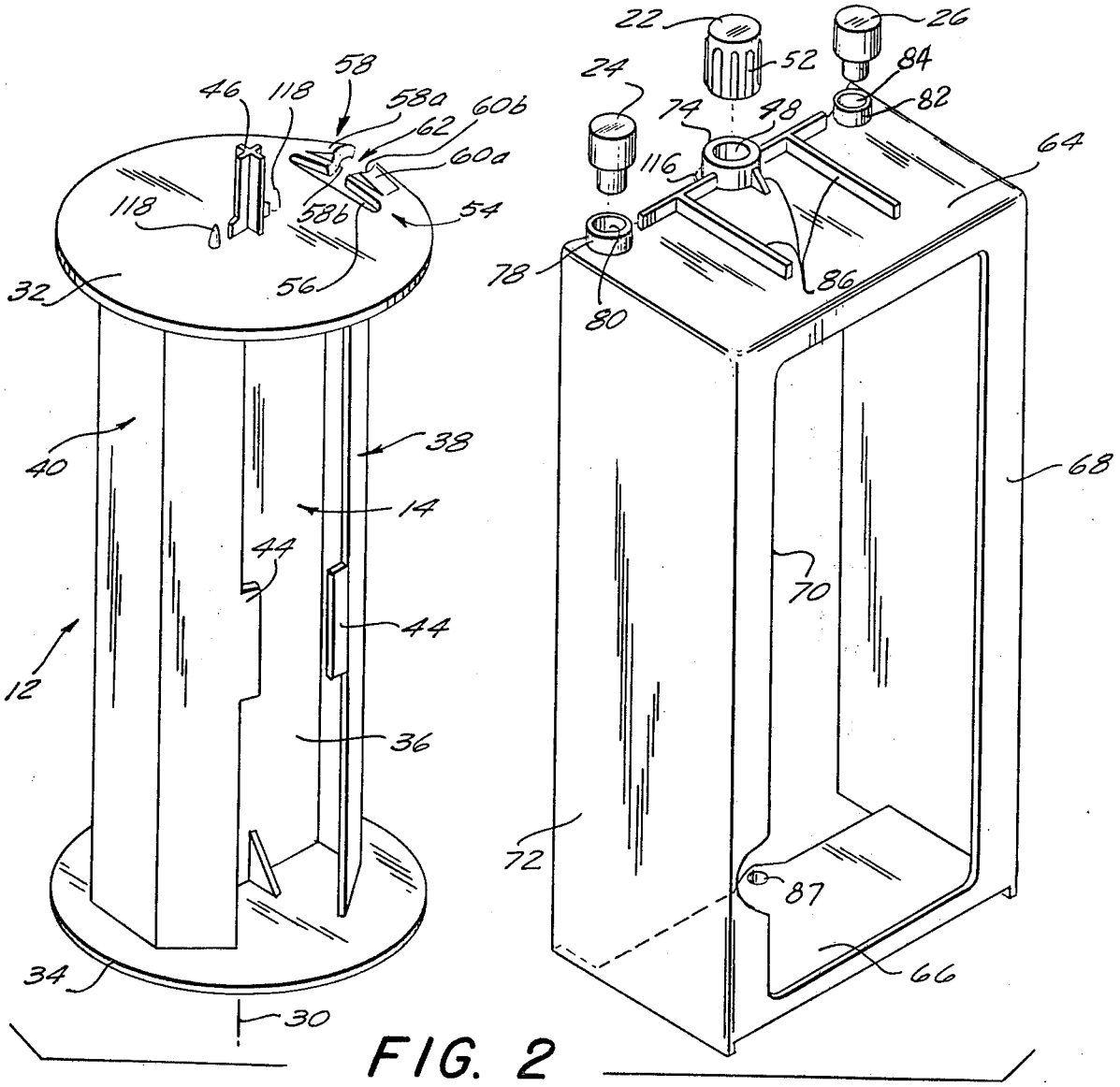
FIG. 2 is an exploded view of the toy of FIG. 1, in perspective, shown without the exterior case or container.

Referring now specifically to the figures, wherein similar or identical parts are designated by the same reference numerals throughout, and first referring to FIG. 1, the optical illusion-producing rotating toy according to the present invention is generally designated by the reference numeral 10. As will be more specifically described in connection with several of the other figures, the toy 10 includes a rotatable housing 12. In the presently preferred embodiment, the rotatable housing 12 is generally cylindrical in shape and has a longitudinal axis of rotation with at least two sides or display areas being angularly disposed about the axis. Only one such display area, chamber or compartment 14 is shown in FIG. 1. The compartment 14 is shown to contain a doll or a figurine 16. As will be described hereafter, the toy 10 can provide an optical illusion of appearance and disappearance of the figurine 16. For this reason, the rotating toy 10 is particularly suitable in different play settings or environments. While a doll or figurine is utilized in the presently preferrred embodiment, it will become clear from the description that follows that any object can be mounted on the rotatable housing 12 to similarly be made to appear and disappear.

The rotatable housing 12 is mounted for free rotation on an inner support housing 18 which at least partly houses the rotatable housing 12. An exterior decorative covering forms a container or a carrying case and substantially covers the support housing 18 with the exception of certain openings which expose the rotatable housing.

Figure 6:
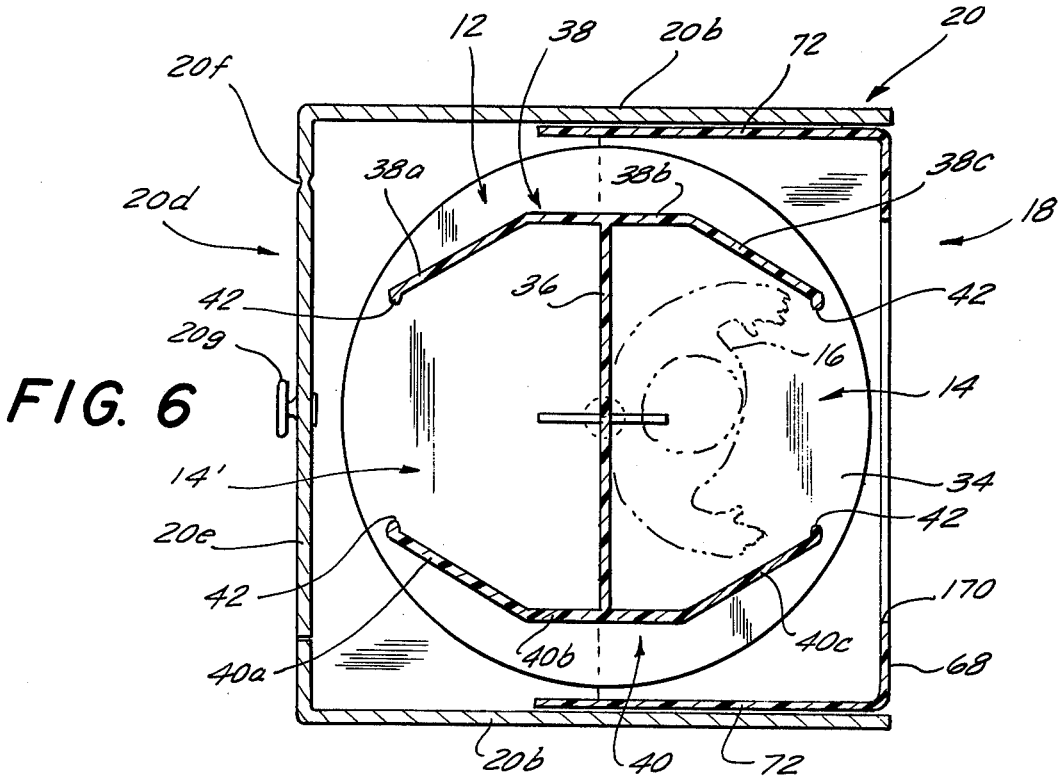
FIG. 6 is a cross-sectional view of the toy shown in FIG. 5, taken along line 6—6, showing the details of the rotatable housing construction for providing the plurality of display areas and also the construction of the exterior case or container.

As shown in FIG. 1, the outer container 20 includes a top wall **20*a*, a pair of side walls 20*b*, a bottom wall 20*c* and, as shown in FIG. 6, a rear wall 20*d*. The aforementioned walls of the outer case 20 may be imprinted with various designs to suggest or adapt the toy to specific games or play environments. A series of holes are provided in the top wall 20*a*. A turning knob 22 projects above the top wall 20*a* and, as will be described hereafter, serves as a rotating means for initially imparting rotation to the rotatable housing 12. Similarly, a pair of buttons 24 and 26 project above the top wall 20*a*, each of the buttons serving as a selection means which, when manually depressed, stops the rotatable housing in one of two angular positions thereof about its axis. In this manner, an initially rotating housing 12 can be selectively stopped in one of the two angular positions by suitable actuation of one of the buttons 24, 26 to bring into view one of the two corresponding different sides or play areas of the rotatable housing 12 at a given point of observation. More specifically, when one of the buttons 24, 26 is depressed, the compartment, chamber or display area 14 may be brought into view through the opening in the support housing 18 and in the outer case 20** as shown. On the other hand, when the other button is depressed, another and diametrically opposite chamber or compartment 14', shown in FIG. 6, is brought into view through the same opening. The rotatable housing 12 blends the various sides thereof during rotation and viewing of any given side or display area is most difficult. Only when the rotatable housing 12 is stopped by depression of one of the buttons 24, 26 is an associated side or display area 14, 14' brought into permanent view. As will further be described hereafter, the rotation of the housing 12 is stopped almost instantaneously and either of the display areas or compartments 14, 14' may be instantaneously brought into view from an initial high speed rotation condition of the rotatable housing. An object or figurine 16 in one of the compartments 14 may be made to appear and disappear by successive actuation of the stop buttons 24, 26.

A handle 28 is advantageously provided on the container 20 to facilitate the carrying of the toy.

Referring to FIG. 2, the details of the rotatable housing 12 and support housing 18 of the presently preferred embodiment are shown. Also making reference to FIGS. 4 and 6, the rotatable housing 12 has an axis of rotation 30 which is also generally an axis of symmetry although this does not have to be the case. Thus, while the rotatable housing 12 is shown to be generally cylindrical in shape, the housing may assume any other desired shape or configuration so long as the housing includes suitable means for permitting the same to be mounted for free rotation about an axis.

In the presently preferred embodiment, the rotatable housing 12 has an upper planar generally circular wall 32 and a lower planar generally circular wall or platform 34 which has a similar diameter as the upper wall 32 and is vertically aligned therewith. A transverse partition wall 36 extends between the wall 32 and 34 and is advantageously integrally formed therewith. The transverse partition wall 36 is shown to extend through the axis of the housing 12 although this is not a critical feature of the present invention. A pair of outer generally arcuate walls 38, 40 each extend along one of the outer vertical edges of the partition wall 36. Each of the walls 36, 38 and 40 are generally oriented in the direction of the axis 30 and extend between the upper and lower walls 32 and 34. The wall 38 is shown to be formed of three planar panels 38*a*, 38*b* and 38*c* and the outer walls 40 is similarly made of panels 40*a*, 40*b* and 40*c*. However, the specific cross-sectional configuration of the walls 38 and 40 is not critical and planar, segmented or curved walls can also be used.

As best shown in FIG. 6, the partition wall 36 and the outer walls 38 and 40 together form the abovementioned chambers, compartments or display areas 14, 14'. Being on opposite sides of the partition wall 36, the display areas 14, 14' are diametrically opposite to each other with reference to the axis of the rotatable housing 12. In the embodiment shown, each of the display areas is in the nature of a three-dimensional space suitable for receiving an object, such as the figurine 16. However, it is possible to provide a different arrangement of vertical walls in place of the walls 36, 38 and 40 to provide as few or as many display areas or compartments or even provide a closed wall which does not exhibit open sides as shown and only exhibits different display surfaces instead of three-dimensional chambers or compartments. A rotatable housing 12*a* having a different arrangement of vertical walls will be described in connection with FIG. 3.

It will be appreciated that an object inserted within one of the chambers 14, 14' will be thrust outwardly due to centrifugal force when the rotatable housing 12 is rotated about its axis. In order to retain the object or figurine 16 within the display area during rotation, various retaining means may be utilized. In the presently preferred embodiment, each of the outer walls 38, 40 is provided along the vertical edges thereof with inwardly extending ribs 42 and, as shown in FIG. 2, still larger sized retaining lugs 44 which project into the open space formed by the opposing edges of the outer walls to block and prevent passage of the object therethrough. In the case of a figurine which is flexible, the arms and legs thereof can be moved outwardly so that they abut against frontwardly disposed portions of the outer walls to provide additional retaining support. Alternately, retaining means such as straps or other conventional fastening devices may be utilized for preventing escape of the object during rotation of the rotatable housing 12.

Figure 5:
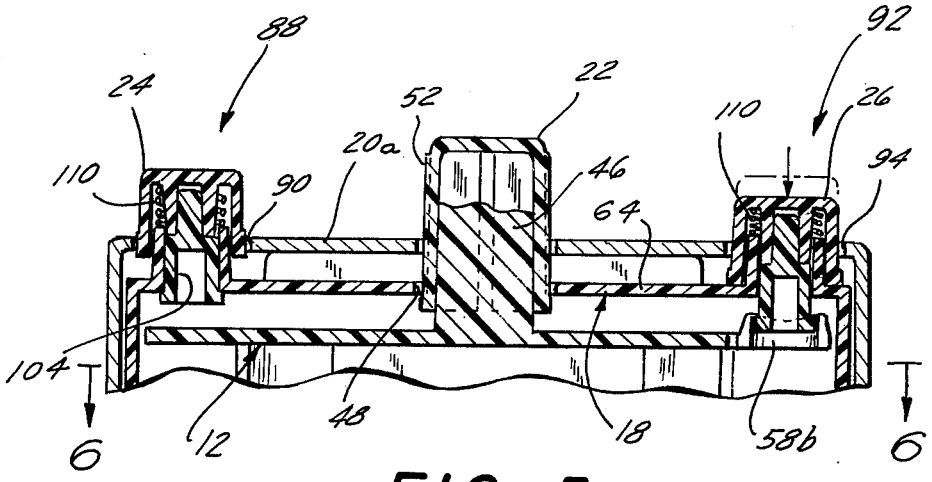
FIG. 5 is an enlarged cross-sectional view of the upper portion of the toy as shown in FIG. 4, taken along line 5—5, to show the details of the latching means for selectively and substantially instantaneously stopping the rotation of the rotatable housing in preselected angular positions thereof about its axis.

Still referring to FIG. 2, the rotatable housing 12 is provided with an axial post 46 which projects upwardly and is shown to have a cross-shaped section. Referring to FIG. 5, the post 46 is shown to extend through a hole 48 in the support housing 18 and a hole 50 in the top wall 20*a* of the case 20 to be accessible exteriorally of the case. The knob 22 is press fitted on the post 46 to facilitate gripping of the same and the post 46 together with the knob 22 form the rotating means for initially rotating the rotatable housing. Advantageously, the exterior surface of the knob 22 is provided with ribs 52 to improve the grip thereon so that the rotatable housing can initially be imparted with a relatively high angular velocity. However, the post 46 and the knob 22 are optional since the rotatable housing 12 may be initially set into rotation by various alternate means. Instead of manually turning the knob 22, any portion of the housing 12 may be manually engaged to impart the desired rotation. Additionally, although not shown, electrical motor means may be coupled to the rotatable housing 12 to rotate the same when the motor is energized. It is only important that the rotatable housing 12 be mounted for free rotation about its axis, as to be more fully described below, and any method for initially imparting rotation to the housing is contemplated by the present invention.

As described above, the rotatable housing 12 is initially set into rotation by any appropriate means. An important feature of the present invention is to provide latching means for selectively stopping the rotatable housing 12 in one of at least two angular positions thereof about its axis. The particular type of latching means is not in and of itself critical. The presently perferred latching means includes an engageable portion 54 provided on the rotatable housing 12 and two or more selection means, to be more fully described hereafter, on the support housing 18. In the presently preferred embodiment, the selection means include the aforementioned buttons 24, 26 which can be manually actuated to engage the engageable portion 54 to stop the rotation of the housing 12 in a manner to be described.

A presently preferred embodiment of the engageable portion 54 is formed by providing a slot 56 in the upper circular wall 32 to form two catches, stops or fingers 58 and 60. As will be clear, the engageable portion 54 on the rotatable housing 12 rotates in a circular path about the axis 30 proximate to the adjacent wall of the support housing 18 with rotation of the rotatable housing.

Figure 7:
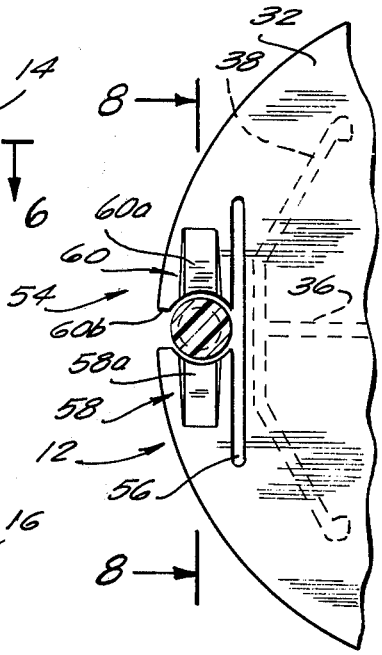
FIG. 7 is an enlarged fragmented top plan view of the upper planar circular wall of the rotatable housing, showing the details of the engageable portion or pair of resilient spring fingers which are engaged by suitable actuation of one of the selection means or buttons accessible exteriorally of the toy for manual actuation.
Figure 8:
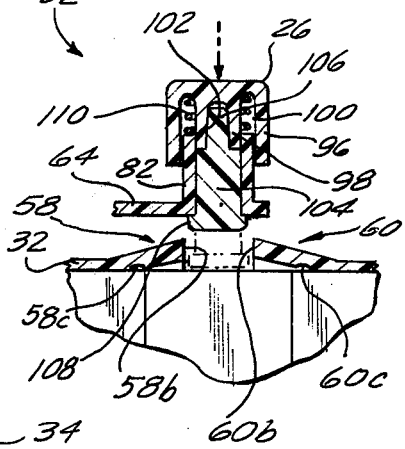
FIG. 8 is an enlarged fragmented cross-sectional view of the latching mechanism as shown in FIG. 7, taken along line 8—8, further showing the details of one selection means in the nature of a button which is manually depressible to engage the engageable portion on the rotatable housing.

Referring to FIGS. 2, 7 and 8, the pair of stops 58 and 60 are in the nature of a pair of resilient fingers which project upwardly from the circular wall 32 and towards each other as shown. Slight tapers 58*a* and 60*a* and are provided on each of the stops 58, 60 respectively to increase the thickness of the fingers at the free edges thereof and thereby structurally strengthen these fingers, for reasons which will become apparent hereafter.

The free ends of the stops 58, 60 are spaced from each other to form a pair of cooperating engaging edges 58*b*, 60*b* which are in opposition to each other and define the circular path in which these resilient fingers move during rotation of the housing 12 and into which the free ends of the buttons 24, 26 move when the same are actuated.

As best shown in FIG. 8, each of the stops 58, 60 is provided with a transverse notch or depression 58*c*, 60*c* respectively or is otherwise provided with at least a flexible portion to make the stops or fingers 58, 60 resilient and downwardly deflectable. The two circular edges 58*b* and 60*b* together define a generally circular opening 62 which is dimensioned to receive with a nominal clearance the free or actuating ends of the selection means as to be described hereafter.

The stops 58, 60 are shown to be disposed along the outer periphery of the circular wall 32 and, for this reason, only a single slot 56 is required. However, as will be more fully described in connection with FIGS. 11–17, the engageable portions may be disposed interiorly of a wall of the rotatable housing and, in such a case, a pair of parallel slots are provided to form the resilient stops or fingers.

As should be evident, the stops are advantageously made of a flexible but relatively hard material, as to be described below. However, the entire rotatable housing need not be made from one material and only at least a portion of the stops must be resilient in order to permit downward deflection thereof. Thus, it is possible only to make the upper circular wall 32 out of such a flexible plastic material or only the stops themselves or portions thereof may be made from such a material. As suggested above, another alternative is to provide weakened line portions such as notches 58*c* and 60*c* for facilitating bending or deflection of these stops.

Referring to FIGS. 2 and 4–6, the stationary or support housing 18 which rotatably supports the rotatable housing 12 is shown to include a top wall 64, a bottom wall 66, a front wall 68 and side walls 72. The housing 18 is generally rectangular in shape and is provided with a rectangular opening or window 70 in the front wall 68 so that the housing 18 has two open sides, namely the front and rear sides, for exposing diametrically opposite sides, chambers or display areas 14, 14′ of the rotatable housing 12.

The primary purpose of the support housing 18 is to rotatably support the housing 12 as well as support the selection means to be described more fully hereafter, but including, for example, the buttons 24 and 26. Accordingly, it is not essential that the support means be in the nature of a rectangular housing as shown but any support means which rotatably supports the housing 12 and the selection means may be used. It is possible, therefore, only to utilize a top wall, a bottom wall or both, each of which may include means for rotatably mounting the housing 12 or mounting the selection means thereon.

Referring particularly to FIG. 2, the support housing 18 is shown to be provided on the top wall 64 thereof with a cylindrical extension 78 which defines a hole 80, the extension 78 being on one diametrical side of the axis which passes through the hole 48 which is defined by the cylindrical wall extension 74. A further cylindrical extension 82 is provided on the opposite diametrical side of the axis or hole 48 and it defines a hole 84. A reinforcing framework of ribs 86 may be provided on the top wall 64 to reinforce this wall against excessive bending or deformation when the buttons 24, 26 are depressed or the knob 22 is turned.

Figure 4:
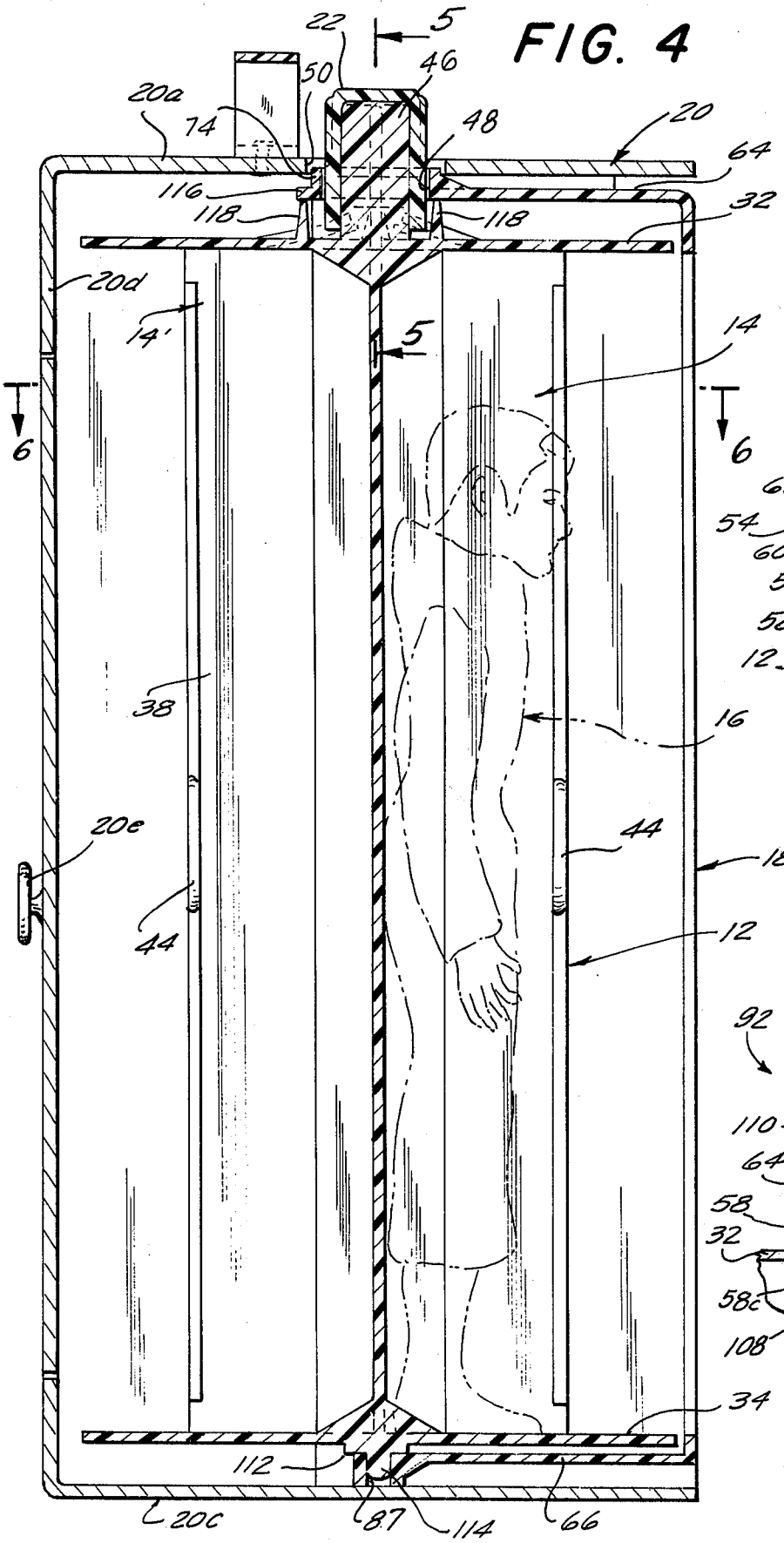
FIG. 4 is an enlarged cross-sectional view of the toy shown in FIG. 1, taken along line 4—4.

The bottom wall 66 of the housing 18 is provided with a hole 87 which is vertically and axially aligned with the hole 48 and together provide the bearing means in which the rotatable housing 12 is mounted for free rotation, as best shown in FIG. 4.

Referring particularly to FIGS. 5 and 8, the selection means will now be described. A first selection means generally designated by the reference numeral 88 is mounted on the top wall 64 and projects above the top wall 20*a* of the outer case through a hole 90. A second selection means, generally designated by the reference numeral 92, extends above the top wall 20*a* through a hole 94. The selection means 88 includes the outer button 24 above described and the selection means 90 includes the outer button 26. The two selection means 88, 92 are on diametrically opposite sides of the axis of rotation of the housing 12 or the knob 22 but otherwise function similarly. For this reason, only one selection means will be specifically described although the same description equally applies to the other selection means. In FIG. 8, the outer button 26 of the selection means 92 is shown to have an outer cylindrical wall 96 and a coaxial inner cylindrical wall 98, these two walls together defining an annular space 100 therebetween. The space 100 is dimensioned to receive the cylindrical extension 82 of the top wall 64 when the outer button 26 is depressed. The inside surface of the inner wall 98 is generally in the nature of a tapered or conical hole 102. The outer button 26 is prevented from moving or separating from the cylindrical portion 82 or the top wall 64 by means of an inner button 104 which has an upper tapered end 106. The tapers on the portion or end 106 and the tapered surface 102 are so selected that the inner button may be press-fitted into the outer button to make connection between these buttons from opposite sides of the cylindrical portion 82. By providing a peripheral or annular lip 108 at the other or lower end of the inner button 104, both buttons in effect become locked to the top wall 64 but the buttons are permitted to slideably move upwardly and downwardly to the extent permitted by the axial length of the annular space 100.

The outer and inner buttons of each selection means are upwardly biased by means of a spring 110 which is disposed in the annular space 100 as shown. The springs 110 urge the buttons upwardly to bring the lips 108 into abutment with the lower surface of the top wall 64.

The engageable portion 54 is spaced at a radial distance from the axis 30 which is equal to the radial spacing of each of the selection means 88 and 92 from the axis. Accordingly, when normally biased in upward directions, the lower portions of the inner buttons 104 are spaced above the circular path in which the engageable portion 54 moves when the housing 12 rotates. However, the dimensions of the inner and outer buttons must be selected so that when the buttons are fully depressed, the lower portions of the inner buttons move into and advantageously somewhat below the circular path in which the engageable portion moves. This will become more evident from the description of the operation below.

A coaxial bearing portion 112 and pin 114 project downwardly from the lower wall or platform 34 of the rotatable housing 12 as best shown in FIG. 4. The pin 114 is received within the hole 87 of the bottom support wall 66 and, therefore, in the presently preferred embodiment the housing 12 is rotatably mounted and supported by both the top wall 64 and the bottom wall 66 of the support housing 18. However, the housing 12 may be supported for rotation at only one of these walls, as will be more fully described in connection with FIG. 17.

Referring particularly to FIGS. 2 and 4, the rotatable housing 12 is shown to be provided with a pair of diametrically spaced projections or nipples 118 one on each side of the post 46. The top wall 64 of the housing 18 is provided with a flange 116 which forms a continuation of the lower surface of the top wall 64 and which extends about the periphery of the cylindrical wall extension 74. The heights of the projections 118 are selected to be approximately equal to the desired spacing between the walls 32 and 64 of the housings 12 and 18 respectively. Therefore, the projections act as spacers and prevent excessive axial movement of the rotatable housing 12 within the housing 18. By tapering the projections as shown, and by limiting the diameter of the bearing portion 112, the contact areas between the housings 12 and 18 are minimized to thereby minimize the frictional forces which end to stop the rotation of the rotatable housing 12 relative to the stationary housing 18. Because of this arrangement, the housing 12 is mounted substantially for high speed and extended free rotation. While the above-described arrangement is simple in construction, it is also possible to use different types of mounting means, including the use of bearings which would still further reduce the above-mentioned frictional forces. Also, as suggested above, a motor can be utilized which is coupled to the rotatable housing 12 for imparting fast and continuous rotation to the housing 12 when the motor is energized.

The operation of the toy 10 will now be described with reference to FIGS. 1–8 to the extent to which it has not been described above. Where it is desired to provide the optical illusion of appearance and disappearance of an object, only one object, such as a figurine or doll, is placed within one of the compartments 14, 14′ and secured therein. Where, however, the desired optical illusion is of one object changing into another, the two desired objects can each be placed into one of the compartments 14, 14′ and each secured in its respective compartment. The knob 22 is now gripped and turned to impart a relatively high rotation speed to the rotatable housing 12. During such high speed rotation, the eye of the observer blends the various surfaces of the rotatable housing and cannot distinguish any one given side or display area. Depression of, for example, the stop button 26 as shown in FIG. 5 brings the engaging or lower portion of the inner button 104 into the circular path of the engageable portion 54. When the rotatable housing 12 rotates in a clockwise direction, as viewed from the top of the housing, the button 104 initially engages the stop or resilient finger 60 and rides or slidingly abuts against the upper surface of the stop 60 to deflect the same substantially into the plane of the outer wall 32. By deflecting the leading resilient finger 60, the button 104 moves into the area of the circular opening 62 and subsequently engages the circular edge **58*b* of the trailing resilient finger 58. Since the finger 58 is not deflected the circular edge 58*b* engages the stationary button 104 and the rotatable housing is brought to a substantial instantaneous stop. Once the button 104 has moved into the area of the circular opening 62, the stop or resilient finger 60 reverts to its uppermost position as shown in FIG. 8, snapping back into place as soon as it disengages from the button 104. Now the inner button 104 is locked between the edges 58*b* and 60*b* and any tendency of the rotatable housing to reverse directions of rotation is prevented by the leading finger 60. Accordingly, the latching means of the present invention which includes the selection means 88, 92 and the engageable portion 54 provides a snap-fitting engagement upon engagement so that the rotatable housing becomes substantially instantaneously locked or frozen in position and prevented from further rotation about the axis 30 upon engagement of the engageable portion 54 with either one of the selection means 88 or 92.**

The above-described operation assumed an initially clockwise rotation of the housing 12. However, the same result would have been achieved if the housing were initially rotated in a counterclockwise direction. With this condition, the finger 58 becomes the leading finger and the finger 60 becomes the trailing finger. The finger 58 would initially become deflected by the inner button 104 and the finger 60 would initially stop the housing by engagement of the button 104 with the edge **60*b*. The finger 58 would thereupon revert to its initial position and positively lock the button 104 within the circular opening 62 to prevent any bounce or reversal in direction of rotation of the housing 12. It will be appreciated that this construction provides an inexpensive and simple positive locking arrangement which stops the rotatable housing substantially instantaneously and in a desired angular position or orientation about the axis 30. For this reason, it is advantageous that the dimensions of the circular opening 60 be selected to closely correspond with the outer diameter of the lower portion of the inner button 104 so that little play may result and that therefore the rotatable housing 12** repeatedly stops in the same angular position each time the same button or selection means is actuated.

As will be evident, depression of the button 26 causes the rotatable housing 12 to stop with the engageable portion 54 to the right of the axis 30, as viewed in FIGS. 1 and 2, and with the chamber or display area 14 facing the observer. On the other hand, depression of the button 24 causes the housing 12 to stop rotating in a position wherein the engageable portion 54 is to the left of the axis 30 to thereby change the angular orientation of the housing 12 by 180° about the axis to display the chamber or area 14′ to the observer. If no object was placed within the chamber 14′, then this reversal on successive actuations of the buttons gives the illusion of disappearance of the object 16. On the other hand, if an object was placed within the compartment 14 then the illusion is that of a transformation or a conversion of one object into another.

Figure 3:
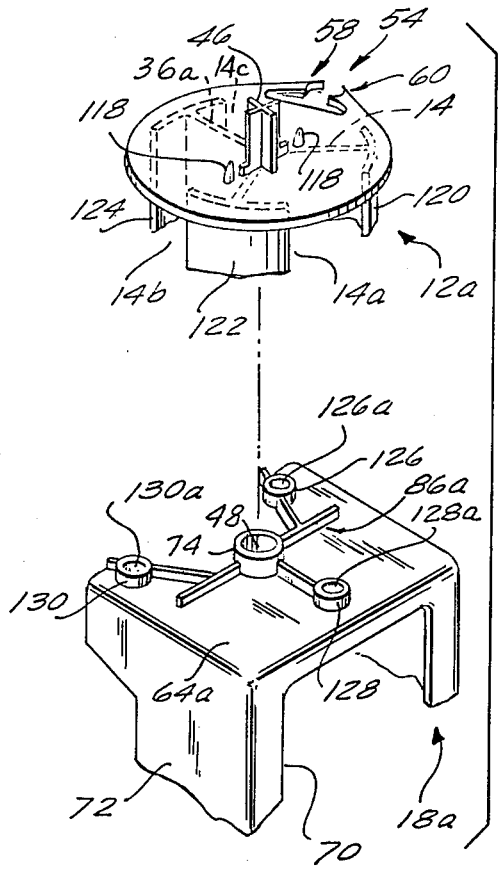
FIG. 3 is a fragmented exploded view similar to FIG. 2, but showing another embodiment of the invention wherein three angularly disposed compartments or chambers are provided on the rotatable housing and three corresponding selection means are provided instead of the two shown in FIGS. 1 and 2.

As suggested above, the rotatable housing 12 can be stopped in angular positions to correspond to the angular positions of the selection means about the axis 30. Since in the above-mentioned embodiments of the toy 10 the buttons 24 and 26 are disposed on diametrically opposite ends of the axis 30, the housing 12 can be stopped in one of two positions which are 180° out of phase or apart. However, referring to FIG. 3, it will be appreciated that the present invention is not limited to two selection means but as many as may be desired. In FIG. 3, another embodiment of the invention is shown wherein the housing 12*a* and the support housing 18*a* are configurated to provide three display areas and three selection means for stopping the rotatable housing in one of the three angular positions. Thus, the rotatable housing 12*a* is provided with three outer arcuate walls 120, 122 and 124 each of which extends along one of the vertical edges of a generally Y-shaped partition wall 36*a*. The legs of the partition wall 36*a* are essentially spaced 120° apart about the axis of rotation to form three display areas 14*a*, 14*b* and 14*c* as shown. A single engageable portion 54 is provided on the rotatable housing 12*a* as in the first embodiment. However, now the support housing 18*a* is provided with cylindrical wall extensions 126, 128 and 130, each of which defines holes 126*a*, 128*a* and 130*a* for receiving selection means or buttons as above-described. The cylindrical extensions 126, 238 and 130 are similarly displaced 120° about the axis of rotation or the hole 48 through which the turning knob 22 extends. The operation of the embodiment shown in FIG. 3 is the same as described above except that now having three selection means, the housing 12*a* can be stopped in one of three angular positions about the axis of rotation to selectively display or expose one of the display areas 14*a*, 14*b* and 14*c* through the opening 70 of the support housing 18*a*. In like manner, the number of display areas can be increased to any desired number. The selection means on the support housing are positioned thereon to stop the rotatable housing in positions to expose the associated or corresponding display areas through the openings or open sides of the outer case 20. In this connection, referring particularly to FIG. 6, the rear wall 20*d* of the outer case is shown to be provided with a door 20*e* which is hingedly connected to the rest of the case at a plastic hinge 20*f* which may be in the form of a weakened vertical line which facilitates the bending thereof. A knob 20*g* may be provided for further facilitating the opening and closing of the door 20*e*. As is evident from an examination of FIG. 6, the opening of the door 20*e* exposes the chamber or compartment 14' when the rotatable housing is in the position shown. In this condition, therefore, the chamber or compartment 14 is visible through the opening 70 of the support housing 18 and the chamber or compartment 14' is visible through the open door 20*e*. The opening of the door 20*e* is suggested in FIG. 10. Where more than two chambers and selection means are provided, it will become evident to one skilled in the art that the outer casing and support housing can be modified to provide more than one door or open spaces to expose as many or as few of the display areas, chambers or compartments when the rotatable housing 12 is brought to a stop.

Referring to FIGS. 9 and 10, the outer case 20 is shown to be modified by the provision of a plurality of folded panels which may be unfolded to provide a play area or environment of which the toy 10 forms a part. Thus, side panels 132 are shown to be hingedly connected to the case 20 at hinges 134. The hinges 134, as well as other hinges to be described may be of any conventional type although the plastic-type hinges of the type similar to hinge 20*f* as shown in FIG. 6 is presently preferred. The side panels 132 can therefore be folded to the closed positions as shown in FIG. 10 and unfolded into planes substantially coplanar with the front wall 68 of the support housing 18 as shown in FIG. 9. Additionally, a series of front panels 136, 138 and 140 can be provided which unfold to the condition shown in FIG. 9 from the folded condition shown in FIG. 10. The middle front panel 136 is hingedly connected to the middle right panel 138 by means of a plastic hinge 142 while the middle front panel is hingedly connected to the middle left panel 140 by means of plastic hinge 144. The middle front panel 136 is hingedly connected to the bottom wall 20*c* of the case 20 so that the panels can easily be folded into a compact condition suitable for carrying. Optional additional side panels 148 and 150 may be provided as suggested in FIG. 9, the panel 148 being hingedly connected at hinges 152 to the side panels 132 and the panels 148 and 150 being hingedly connected to each other at hinges 154. Where the optional panels are provided a substantially three-dimensional play area or arena 156 is formed of which the rotatable toy 10 forms a part. The inside surfaces of the various folded panels are advantageously imprinted with designs or information which are consistent with the game to be played or the environment or setting which is desired. Clearly, any game or play environment with which the toy 10 may be appropriately used is contemplated by the present invention. For example, the play area 156 may be in the nature of a building environment and the toy 10 may be considered to be an elevator which moves passengers between different floors. Also, the play arena or environment may be that of a science fiction spaceship and the toy 10 may represent a time capsule or space capsule which can transport individuals, for example, into the past, into the future, or between two locations which are great distances apart from each other. Other applications and uses of the toy as well as different environments will become evident to those skilled in the art. In this connection, it may also be desired to cover the outside or exterior surfaces of the outer arcuate walls of the rotatable housings with pattern labels which enhance the optical illusion effect. For example, it has been found that patterns which include boxes, circles or the like enhance the optical illusion effect by providing a dominant color which is mostly visible during rotation of the rotatable housing and which, therefore, masks the colors or objects inside the display areas of the rotatable housings. It has been found that yellow and black patterned labels having a repetitive design formed of, for example, circles and squares in which the yellow color is dominant, adequately serves this function.

Figure 11:
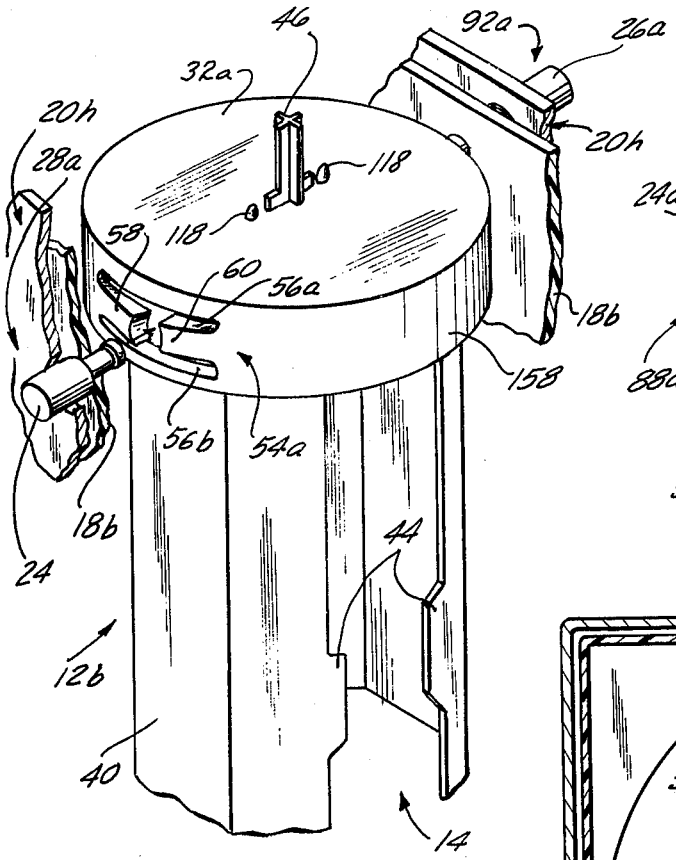
FIG. 11 is a fragmented perspective view of the rotating toy in accordance with the present invention, showing another embodiment wherein the selection buttons are provided on the sides of the toy instead of on the top as is the case with the first described embodiment.
Figure 12:
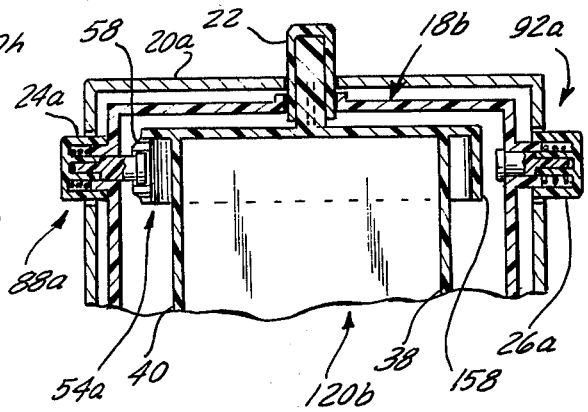
FIG. 12 is a cross-sectional view of the embodiment shown in FIG. 11, taken through an axial plane extending through the latching or selection means, and further showing the details of the case construction for this embodiment.

Referring to FIGS. 11 and 12, still another embodiment of the present invention is shown wherein the selection means 88*a* and 92*a* are on the sides of the toy as opposed to being on the top thereof. With this arrangement, the upper wall 32*a* is provided with a cylindrical skirt 158 which is formed with two axially spaced slots 56*a* and 56*b* to form the engageable portion 54*a* including the stops or fingers 58 and 60 as described above. Suitable holes are provided in the support housing 18*b* and in the outer container 20*h* through which the selection means 88*a* and 92*a* can be resiliently actuated. The operation of the toy is the same as described above with the exception that the buttons 24*a* and 26*a* must now be pressed in from the sides as opposed to pressing them down from the top.

Figure 14:
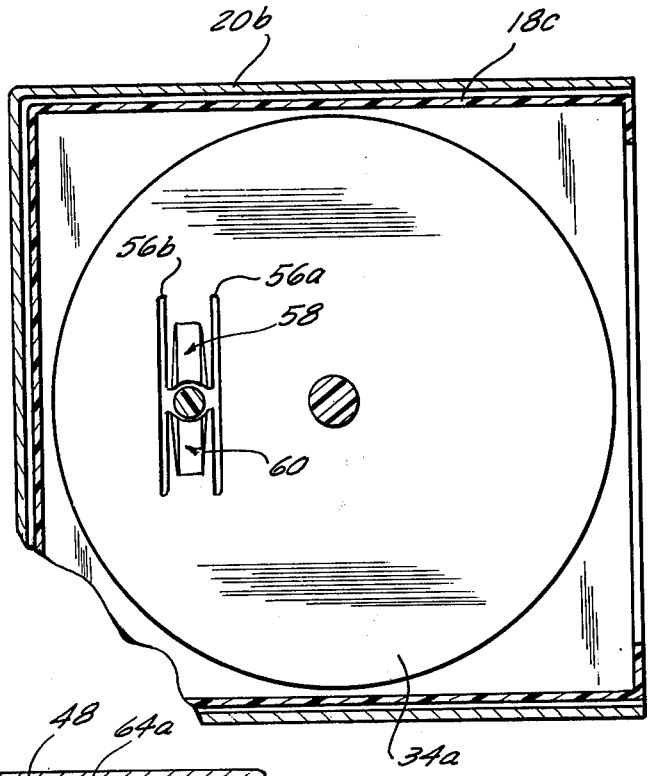
FIG. 14 is a cross-sectional view of the embodiment shown in FIG. 13, taken along line 14—14.
Figure 13:
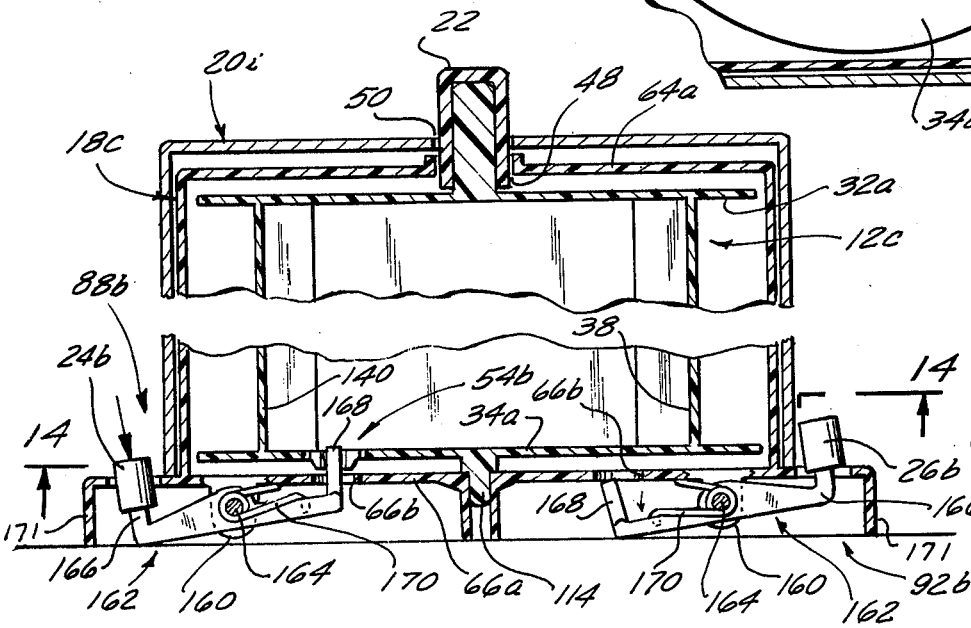
FIG. 13 is a fragmented cross-sectional view taken along a longitudinal plane extending through the axis of the toy, showing still another embodiment of the present invention wherein modified selection members are provided in the lower region of the rotatable housing with the engageable portion being on the bottom wall of the same and the selection means being in the nature of pivotally mounted levers in place of direct action buttons.

Still another embodiment of the present invention is shown in FIGS. 13 and 14 wherein the selection means 88*b* and 92*b* are provided at the bottom of the toy as opposed to the top as described above. Here, the case 20*i* is not provided with any holes therein for the actuating buttons although it is provided with a hole 50 for the knob 22 as above described. Similarly, the top wall 64*a* of the support housing 18*c* is only provided with the single hole 48 as shown in FIG. 13.

In this embodiment, the rotatable housing 12*c* is provided with the latching means 54*b* on the lower wall 34*a* as opposed to the top wall 32*a*. The fingers 58 and 60 project downwardly but is in other respects identical to the above-described engageable portions. Since the two selection means 88*b* and 92*b* are identical in construction except that they are disposed diametrically on opposite sides of the axis or rotating pin 114, only one of the selection means will be described although the description is equally applicable to the other selection means. The bottom wall 66*a* is provided with a downwardly extending projection 160 for each selection means which pivotally supports a generally U-shaped lever 162 by means of a pin 164. The levers 162 are generally oriented in a radial direction as shown. The radially outwardly extending leg 166 extends upwardly and supports a button 24*b* which is exteriorally accessible for manual depression. The inwardly and upwardly extending leg 168 is dimensioned and oriented in a direction to be suitable for passage through a hole 66*b* of the bottom wall 66*a* when the button 24*b* is depressed. A spring 170 biases the levers 162 to a position wherein the buttons are upwardly and the legs 168 are downwardly disposed, as is the selection means 2*b* in FIG. 13. In the normal positions of the levers, the legs 168 are removed from the circular path of movement of the engageable portion 54*b*. Only upon depression of one of the buttons 24*b* or 26*b* does one of the legs 168 move into the circular path of movement of the engageable portion 54*b* for engagement and locking as above described. It will be appreciated that in the use of the embodiment shown in FIGS. 13 and 14, the support housing 18 must be somewhat modified to provide downwardly extending walls 171 which are of sufficient height to provide a space between the bottom wall 66*a* and the support surface on which the toy rests which is sufficient and in which the levers 162 can move between the desired engaging and non-engaging positions. It will be evident that more than two levers 162 can be provided as above suggested where more than two display areas are provided on the rotatable housing and these levers are then disposed about the axis of rotation in accordance with the principles above discussed.

In each of the above-described embodiments, only a single engageable portion is provided on the rotatable housing. Each of the selection means, when actuated, engages that engageable portion to stop the housing in a desired position. However, referring to FIGS. 15 and 16, a further embodiment of the invention is shown wherein each of the buttons 24*c* and 26*c* are associated with another engageable portion 54*c* and 54*d* on the upper wall 32*b*. In this embodiment, the rotatable housing 12*d* is provided with a first engageable portion 54*c* which is spaced from the axis of rotation 30 by the radial distance 174. The button 24*c* is similarly spaced a distance 174 so that depression of the button 24*c* causes the same to engage the engageable portion 54*c*. The upper wall 32*b* is also provided with a second engageable portion 54*d* which is radially spaced from the axis of rotation 30 by a greater distance 172. The button 26*c* is similarly radially spaced a distance 172 from the axis of rotation so that actuation of the button 26*c* causes only the same to engage the engageable portion 54*d*. In this embodiment, therefore, each selection means or button has associated therewith its own engageable portion on the rotatable housing and actuation of the button will cause engagement thereof only with its own or associated engageable portion due to the different radial spacings of the engageable portions and selection means from the axis. However, the operation of the toy and the latching mechanism is in all other respects identical. Clearly, with this arrangement, the outer case 20*j* and the support housing 18*d* must be provided with corresponding holes which are variously spaced from the axis of rotation to correspond with the distances 172 and 174 so that the buttons may extend therethrough.

In each of the above-described embodiments, the rotatable housing was rotatably supported at both the top and bottom walls of the support housing 18. Such mounting of the rotatable housing was effected by the insertion of the pin 114 into the hole 87 and the passage of the knob 22 through the hole 48 in the top wall 64. By providing little clearance between the hole 48 and the turning knob 22, each of the holes 48 and 87 provided suitable bearing surfaces which maintained the rotatable housing in a relatively stable condition during high speed rotation. This is desirable both to assure continued free rotation of the housing as well as any possible damage to the bearing means if the rotatable housing were mounted with large clearances which permitted the housing to deviate substantially from its normally vertical axis of rotation. However, it is not necessary that the rotatable housing be mounted at both the upper and lower ends thereof to achieve the desired result. Referring to FIG. 17, yet a further embodiment of the invention is shown wherein the rotatable housing is only supported for rotation at the lower end thereof. Here, the rotatable housing 12*e* is shown to be provided with a somewhat longer pin 114*a*. The support housing 18*e* is provided with a correspondingly longer bearing or sleeve 18*f* which has a correspondingly longer hole 87*a*. It will be appreciated that the longer pin 114*a* and hole 87*a* are adequate to maintain the rotatable housing 12*e* in a generally upright position even when the rotatable housing turns at a high velocity. With this embodiment, the support housing 18*e* does not extend to the region of the knob 22 and does not provide the hole 48 for stabilizing the upper end of the rotatable housing 12*e*. Clearly, the outer case 20*k* must also be modified to take into account the greater height of the toy due to the provision of the longer sleeve 18*f* and any reinforcing framework 18*g* for structurally strengthening the support housing 18*e* at the lower region thereof. A person skilled in the art can similarly modify the support housing and the toy to rotatably support the rotatable housing only at the upper end thereof. Based on the above, it becomes clear that it is not critical how the rotatable housing is supported or where the latching or selection means are mounted. It is only important that a rotatable housing provided with two or more display areas be provided which can be initially set into free rotation and two or more selection means be provided for stopping the housing in one of a plurality of selected or desired positions. Where a motor is utilized to rotate the rotatable housing, as above suggested, means are advantageously provided for disconnecting or de-energizing the motor upon the actuation of one of the selection means. Suitable circuitry for accomplishing this result will be evident to those skilled in the art.

While the latching means above described in connection with the presently preferred embodiment consisted of engageable portions 54 and selection means 88 and 92, the present invention also contemplates other forms of latching means. For example, it is possible to utilize electromagnets as the selection means and a permanent magnet as the engageable portion which rotates with the rotatable housing. Energization of one of the electromagnets establishes a strong magnetic shield in the region thereof which attracts the permanent magnet to cause the rotatable housing to stop. Further examples of possible latching means include magnetic or frictional clutches which can be used to stop rotation of the housing 12 upon operation of these clutches in well-known manners. However, the presently preferred latching means is extremely simple in construction and economical to manufacture and works in a reliable manner. An important characteristic of the presently preferred latching means, as above described, is the snap-type action thereof which substantially instantaneously stops the rotation of the housing while preventing bounce or reversals in the direction of the housing subsequent to stopping.

The specific materials from which the various parts of the toy 10 are made is not critical for purposes of the present invention. Any suitable materials well known to those skilled in the art may be used. The material which may be used for the rotatable housing 12 and support housing material is any moldable plastic material, such as high impact styrene. The inner and outer buttons 104 and 26 respectively may similarly be made from a moldable plastic material such as "Celcon". The case 20 may be formed from a cardboard blank or series of cardboard panels which are advantageously covered on both sides by a polyethylene sheet or layer which serves both to project the panels as well as to form the integral or plastic hinges above described. These aforementioned materials are only given by way of illustration and are not intended in any way to limit the materials which can be used for any of the parts of the toy 10.

It is to be understood that the foregoing description of the various embodiments illustrated herein is exemplary only, and various modifications to the embodiments shown may be made without departing from the spirit and the scope of the invention.

What is claimed is:

1. An optical illusion-producing rotating toy comprising support means; a generally elongate rotatable housing having an axis of rotation and mounted for free rotation on said support means; and latching means for selectively stopping said housing when the same is rotating in one of at least two angular positions thereof about said axis, said support member being structured to generally conceal said rotatable housing, while allowing it to be viewed from one point of observation, whereby said rotatable housing, when in a state of rotation, can be selectively stopped in one of said at least two angular positions by suitable actuation of said latching means to bring into view one of at least two corresponding different sides of said rotatable housing when viewing said toy from said one point of observation, said rotatable housing having sides and blending the sides thereof during rotation to make observation of any one individual side difficult until said rotatable housing has been stopped by said latching means, said latching means comprising engageable means on said rotatable housing which rotates in a circular path about said axis proximate to said support means with rotation of said rotatable housing; and at least two selection means on said support means each for engaging said engageable means and stopping the rotation of said rotatable housing in a respective associated angular position thereof about said axis, each of said selection means comprising a member mounted on said support means for movement between a first position for engagement with said engageable means, and a second position for disengagement from said engageable means, and resilient means for normally maintaining said member in said second position.

2. A toy as defined in claim 1, wherein two selection means are provided on said support means and disposed at diametrically opposite sides of said axis, whereby diametrically opposite sides of said housing come into view at said point of observation when said housing stops.

3. A toy as defined in claim 1, wherein three selection means are provided on said support means and angularly spaced from each other approximately 120° about said axis, whereby one of three sides of said rotatable housing spaced from each other approximately 120° come into view at said observation point when said rotatable housing stops in a position associated with one of said three selection means.

4. A toy as defined in claim 1, wherein said rotatable housing includes a planar end wall disposed in a plane substantially perpendicular to said axis, said engageable means being provided on said planar end wall.

5. A toy as defined in claim 1, wherein said rotatable housing includes a skirt in the nature of a cylindrical wall portion coaxial with said axis, said engageable means being provided on said skirt.

6. A toy as defined in claim 5, wherein said skirt is disposed at an axial end of said rotatable housing.

7. A toy as defined in claim 1, wherein said rotatable housing comprises a planar end wall normal to said axis, said engageable means being provided on said planar end wall; and said support means including a wall substantially parallel with said planar end wall, said members being mounted on said support means wall and having lengths sufficient to bridge the space between said parallel walls in the first positions of said members to engage said engageable means.

8. A toy as defined in claim 7, wherein said axis is oriented in a vertical direction, and said support means wall is disposed proximate and above the upper end of said rotatable housing.

9. A toy as defined in claim 8, wherein said members are buttons resiliently mounted on said support means wall which are manually depressible along substantially vertical lines of action to engage said engageable means.

10. A toy as defined in claim 7, wherein said axis is oriented in a vertical direction, and said support means wall is disposed proximate and below the lower end of said rotatable housing.

11. A toy as defined in claim 10, wherein said members are levers pivotally mounted at intermediate portions on said support means wall, each lever having an upwardly turned portion at one end thereof which is adapted to engage said engageable means when the other end of the respective lever is actuated.

12. A toy as defined in claim 1, wherein said axis is oriented in a vertical direction and wherein said rotatable housing includes a skirt in the nature of a cylindrical wall portion coaxial with said axis, said engageable means being provided on said skirt; and said support means comprising wall portions proximate and spaced from said skirt, said members being in the nature of buttons resiliently mounted on said support means wall portions which are manually depressible along substantially horizontal lines of action to engage said engageable means.

13. A toy as defined in claim 1, wherein each selection means comprises a free end portion which may be brought into said circular path upon actuation of the respective selection means to engage said engageable means.

14. A toy as defined in claim 13, wherein said engageable means and said free end portions are configurated to provide a snap-fitting engagement upon engagement therebetween, whereby said rotatable housing becomes substantially instantaneously locked or frozen in position and prevented from further rotation about said axis upon engagement of said engageable portion and a free end portion of a selection means.

15. A toy as defined in claim 14, wherein said engageable means comprises a pair of stops spaced from each other substantially along a circular arc concentric with said axis, said pair of stops being adapted to engage one of said selection means when the same is actuated independently of the direction of rotation of said rotatable housing.

16. A toy as defined in claim 15, wherein said pair of stops are in the nature of a pair of resilient fingers which project from said rotatable housing towards said selection means and towards each other to form a pair of spaced engaging edges in opposition to each other and define said circular path to engage said free end portions of said selection means when the same are actuated, whereby actuation of a selection means causes an associated free end portion to cause said respective free end to deflect a leading resilient finger during rotation of said rotatable housing and subsequently engage said respective free end with the engaging edge of the trailing resilient finger to block further rotary movement of the latter with respect to the former.

17. A toy as defined in claim 16, wherein said free end portions of said selection means have a circular cross-section, and wherein said opposing engaging edges together define a circular opening which is dimensioned to receive a free end portion of a selection means, whereby upon engagement between a free end portion and an engaging edge of a trailing resilient finger, the initially deflected leading resilient finger reverts to its undeflected position to form said circular opening to now lock the position of said free end portion between said opposing engaging edges.

18. A toy as defined in claim 15, wherein said pair of stops are spaced from each other about the circumference of said rotatable housing.

19. A toy as defined in claim 15, wherein said rotatable housing includes a wall provided with at least one slot extending along said stops to form the same.

20. A toy as defined in claim 15, wherein said stops are made of a flexible plastic material which permits deflection of said stops and which is sufficiently rigid to withstand the forces imparted thereto by said free end portions of said selection means.

21. A toy as defined in claim 1, wherein said engageable means comprises a single engageable portion which rotates in a single circular path, and said at least two selection means are angularly disposed about said axis at equal radial distances from the same, said selection means being positioned to engage said single engageable portion upon selective actuation of the respective selection means.

22. A toy as defined in claim 1, wherein said engageable means comprises at least two engageable portions on said rotatable housing at different radial distances from said axis, and wherein said at least two selection means are each radially spaced from said axis to engage an associated one said engageable portions.

23. A toy as defined in claim 1, further comprising rotating means for initially imparting rotation to said rotatable housing.

24. A toy as defined in claim 23, wherein said rotating means comprises an axial projection extending from said rotatable housing; and gripping means on said projection to facilitate gripping thereof.

25. A toy as defined in claim 1, wherein each of said different sides of said rotatable housing is in the nature of a display area.

26. A toy as defined in claim 25, wherein said display areas are three-dimensional and are in the nature of adjacent chambers or compartments angularly spaced about said axis, each of said chambers being dimensioned to receive an object which can be made to appear and disappear at said point of observation by selective actuation of said latching means.

27. A toy as defined in claim 1, wherein said rotatable housing has at least one partition wall generally oriented in the direction of said axis for forming at least two display areas.

28. A toy as defined in claim 27, wherein said partition wall is a planar wall having vertical edges and passing through said axis, and an outer wall extending along each said vertical edge to form a display area on each side of said partition wall.

29. A toy as defined in claim 28, wherein said outer walls are arcuate and are dimensioned to provide each display area with an open side formed by the spaced edges of said arcuate walls to expose the interiors of said display areas.

30. A toy as defined in claim 29, further comprising retaining means for retaining an object within one of said display areas during rotation of said rotatable housing against the effect of centrifugal forces acting on said object.

31. A toy as defined in claim 30, wherein said retaining means are associated with said arcuate walls and comprise inwardly directed portions extending into the open sides formed by said arcuate walls, said portions being arranged to at least partially bridge said open sides and prevent an object from moving therethrough.

32. A toy as defined in claim 27, wherein said partition wall is a Y-shaped wall having three vertical edges symmetrically disposed 120° apart about said axis, and an outer wall extending along each said vertical edge to form three adjacent display areas angularly disposed about said axis.

33. A toy as defined in claim 1, wherein said support means includes at least a top wall for supporting a portion of said latching means.

34. A toy as defined in claim 1, wherein said support means includes at least a bottom wall for supporting a portion of said latching means.

35. A toy as defined in claim 1, wherein said support means includes at least a top wall including bearing means for rotatably supporting an upper portion of said rotatable housing.

36. A toy as defined in claim 1, wherein said support means includes at least a bottom wall including bearing means for rotatably supporting a lower portion of said rotatable housing.

37. A toy as defined in claim 1, wherein said support means comprises a generally rectangular housing at least partially containing said rotatable housing, said support means housing having top and bottom walls respectively above and below said rotatable housing and including bearing means for rotatably mounting said rotatable housing on said top and bottom walls.

38. A toy as defined in claim 37, wherein at least a portion of said latching means is mounted on one of said top and bottom walls.

39. A toy as defined in claim 37, wherein said support means housing has side walls, and at least a portion of said latching means is mounted on said side walls.

40. A toy as defined in claim 37, wherein said support means housing has side walls provided with at least one open side to expose one of said different sides of said rotatable housing when the latter is stopped.

41. A toy as defined in claim 40, wherein a plurality of open sides are provided on said support means housing which are angularly spaced about said axis to correspond to the angular spacing of said sides of said rotatable housing, said selection means being arranged to stop said rotatable housing in a position aligned with said support means housing to expose the different sides of said rotatable housing through said support means open sides.

42. A toy as defined in claim 1, further comprising limiting means associated with said rotatable housing for limiting axial movements thereof relative to said support means.

43. A toy as defined in claim 1, further comprising covering means for covering said support means and rotatable housing.

44. A toy as defined in claim 43, wherein said covering means is made from cardboard.

45. A toy as defined in claim 43, wherein said covering means includes openings therethrough for providing access to said latching means.

46. A toy as defined in claim 43, wherein said covering means includes handle means for carrying said toy.

47. A toy as defined in claim 43, wherein said covering means includes at least one open side for exposing at least one of said sides of said rotatable housing.

48. A toy as defined in claim 43, wherein said covering means includes door means for selectively exposing at least one of said sides of said rotatable housing.

49. A toy as defined in claim 43, wherein said covering means comprises a plurality of foldable panels which can be unfolded to form a play area environment of which said toy becomes a part.

50. A toy as defined in claim 1, in combination with a toy carrying case which houses said rotating toy and which can be opened to form a play area environment of which said toy becomes a part.

51. A rotatable toy device comprising rotatable means having an axis and a wall surface defining at least two display areas, said wall surface being generally disposed in the same direction as said axis; stationary means for supporting said rotatable means, manually-operable means for spinning said rotatable means relative to said supporting means at a high rotational speed sufficient to blend the wall surface of said rotatable means into a blur whereby said display areas cannot be visually distinguished from one point of observation, and means for precluding the rotation of said rotatable means including an engageable portion on said rotatable means, and a plurality of latching devices each mounted on said supporting means in stationary relationship relative thereto for selective manual actuation, each said latching device corresponding to a respective said display area and being positioned, when actuated, to engage said engageable portion to instantly stop said rotatable means from rotation and lock said rotatable means in a position with a corresponding said display area located in alignment with said one point of observation, each of said latching devices having a portion movable relative to said support means between a first position engaging said engageable portion and a second position disengaged from said engageable portion, whereby upon engagement of the movable portion of a selected said latching device with said engageable portion, a corresponding said display area is displayed at said one point of observation.

* * * * *